US007670199B2

(12) United States Patent
Nagata et al.

(10) Patent No.: US 7,670,199 B2
(45) Date of Patent: Mar. 2, 2010

(54) ELECTRIC CONNECTOR

(75) Inventors: Takayuki Nagata, Yao (JP); Hayato Kondo, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/144,965

(22) Filed: Jun. 24, 2008

(65) Prior Publication Data

US 2009/0017646 A1 Jan. 15, 2009

(30) Foreign Application Priority Data

Jul. 13, 2007 (JP) ..... 2007-184049

(51) Int. Cl.
*H01R 13/73* (2006.01)

(52) U.S. Cl. ..... 439/941; 439/101; 439/608

(58) Field of Classification Search ..... 439/941, 439/101, 608

See application file for complete search history.

(56) References Cited

U.S. PATENT DOCUMENTS 6,368,155 B1 * 4/2002 Bassler et al. ..... 439/620.21
6,439,931 B1 * 8/2002 Niitsu et al. ..... 439/660
6,575,789 B2 * 6/2003 Bassler et al. ..... 439/609
6,945,796 B2 * 9/2005 Bassler et al. ..... 439/101

FOREIGN PATENT DOCUMENTS

JP 2003-505826 A1 2/2003
WO WO 01/06602 A1 1/2001

* cited by examiner

*Primary Examiner*—Truc T Nguyen
(74) *Attorney, Agent, or Firm*—Kratz, Quintos & Hanson, LLC

(57) ABSTRACT

An electric connector includes an insulative body and groups of contacts. The contacts are disposed in spaced relationship inside the body and arranged in at least two rows in a lateral direction of the body. The groups of contacts include a plurality of first contacts; and a plurality of second contacts located in a different row from a row where their associated first contacts exist, the second contacts being arranged next to the first contacts. Out of one of the first contacts and one of the second contacts subject to impedance tuning, one of these two contacts has a width and an area thereof adjusted in accordance with a difference in impedance from impedances between other first and second contacts.

10 Claims, 7 Drawing Sheets

(a)

(b)

(a)

(b)

ELECTRIC CONNECTOR

The present application claims priority under 35 U.S.C. §119 of Japanese Patent Application No. 2007-184049 filed on Jul. 13, 2007, the disclosure of which is expressly incorporated by reference herein in its entity.

BACKGROUND OF THE INVENTION

1. Field of the Invention

The present invention relates to an electric connector used mainly for high-speed digital signaling and capable of providing good impedance matches.

2. Description of the Related Art

In a known electric connector of this type, an insulative body has groups of contacts disposed in two rows along its width, and the groups of contacts are arranged in a zigzag manner. The groups of contacts include ground contacts and pairs of signal contacts to serve as differential pairs for high-speed digital signaling.

Some of the ground contacts are wider than some of the signal contacts making up a pair, and each of the ground contacts is arranged so that their widthwise ends overlaps widthwise ends of each pair of signal contacts in plain positions. With this structure, impedance is matched within each differential pair of contacts and among the differential pairs of contacts (see Japanese Published Patent Publication No. 2003-505826, which is the translation of Published International Application No. WO01/006602).

However, as to a differential pair located at an outermost end of the groups of contacts, there is no ground contact disposed at one side of a signal contact of the differential pair. Therefore, capacitance of this signal contact with respect to a ground contact is smaller as compared with that of the other signal contact of the same differential pair, with the result of increased impedance. For this reason, there are impedances mismatches between the contacts, thereby degrading transmission characteristics of the connector.

In this case, it is not impossible to improve impedance matching by disposing a dummy ground contact at the side of the signal contact in question or by bringing a portion of a shield cover of the electric connector close to the signal contact. However, the addition of a dummy ground contact or the change in shape of the shield cover will cause increase in the number of components and assembly steps, leading to increased costs.

SUMMARY OF THE INVENTION

The present invention was made in view of the above circumstances, and it is an object of the present invention to provide an electric connector capable of providing good impedance matches without adding a dummy ground contact or changing the shape of the shield cover.

In order to overcome the above problems, an electric connector according to the present invention includes an insulative body; and groups of contacts disposed in spaced relationship inside the body, the contacts being arranged in at least two rows in a lateral direction of the body. The groups of contacts include a plurality of first contacts; and a plurality of second contacts located in a different row from a row where their associated first contacts exist, the second contacts being arranged next to the first contacts. Out of one of the first contacts and one of the second contacts subject to impedance tuning, one of these two contacts has a width and an area thereof adjusted in accordance with a difference in impedance from impedances between other first and second contacts.

With such an electric connector, since one of the two contacts subject to impedance tuning has a width and an area thereof adjusted in accordance with a difference in impedance from impedances between other first and second contacts, impedance can be matched between the first and second contacts without adding a dummy ground contact or changing the shape of the shield cover; therefore, transmission characteristics of the connector can be improved without increase in costs.

The first and second contacts subject to impedance tuning may be first and second contacts at an outermost end in the groups of contacts in the lateral direction of the body. In this case, one of the first and second contacts present at the outermost end has its width and area adjusted in accordance with a difference in impedance from impedances between other first and second contacts.

The groups of contacts may be arranged such that a plurality of sets are disposed in the lateral direction of the body with respective vertical positional relationships of the sets turned upside down alternately. Each of the sets may made up by a pair of first contacts and a second contact, and the first contacts may be signal contacts and the second contact may be a ground contact. In this case, the pair of first contacts opposes the second contact within each set, while the pair of first contacts are positioned next to second contacts from other sets. This contact arrangement is advantageous in terms of impedance matching and reduction in crosstalk within each pair of first contacts.

It is preferred that in each of the sets, widthwise ends of the second contact are so positioned as to overlap widthwise inner ends of the pair of first contacts in plain position. This arrangement is advantageous in terms of impedance matching within each pair of first contacts.

Preferably, an overlapping width and area N1 is larger than an overlapping width and area N2, wherein N1 is an overlapping width and area where an outer end of a second contact at an outermost widthwise end of the groups of contacts overlaps, in plain position, a first contact at the outermost end, and N2 is an overlapping width and area where an outer end of another second contact overlaps, in plain position, an inner end of another first contact.

In this case also, impedance can be matched within the pair of first contacts at the outermost end without adding a dummy ground contact or changing the shape of the shield cover.

The electric connector may be configured such that the first contacts each include a first main portion to be held in the body, a first contact portion continuous from a distal end of the first main portion and exposed from a first end in a longitudinal direction of the body, a first lead-out portion continuous from a rear end of the first main portion and exposed from a second end in the longitudinal direction of the body, and a first lead portion continuous from a rear end of the first lead-out portion, while the second contacts each include a second main portion to be held in the body, an widthwise end of the second main portion being located in such a plain position as to overlap an widthwise end the first main portion of the nearest first contact, a second contact portion continuous from a distal end of the second main portion and exposed from the first end in a longitudinal direction of the body, a second lead-out portion continuous from a rear end of the second main portion and exposed from the second end in the longitudinal direction of the body, and a second lead portion continuous from a rear end of the second lead-out portion. In this case, an overlapping width and area N1 is preferably larger than an overlapping width and area N2, wherein N1 is an overlapping width and area where an outer end of a second main portion of a second contact at an outermost widthwise end of the groups of contacts overlaps, in plain position, a first main portion of a first contact at the outermost end, and N2 is an overlapping width and area where an outer end of a second main portion of another second contact overlaps, in plain position, an inner end of a first main portion of another first contact.

BRIEF DESCRIPTION OF THE DRAWINGS

FIG. 3A shows a state in which a shield cover is closed, whereas FIG. 3B shows a state in which the shield cover is opened.

FIG. 6A is a schematic plan view and FIG. 6B is a schematic bottom view.

DETAILED DESCRIPTION OF THE PREFERRED EMBODIMENTS

An electric connector according to an embodiment of the present invention will be described below with reference to the drawings.

Figure 1:
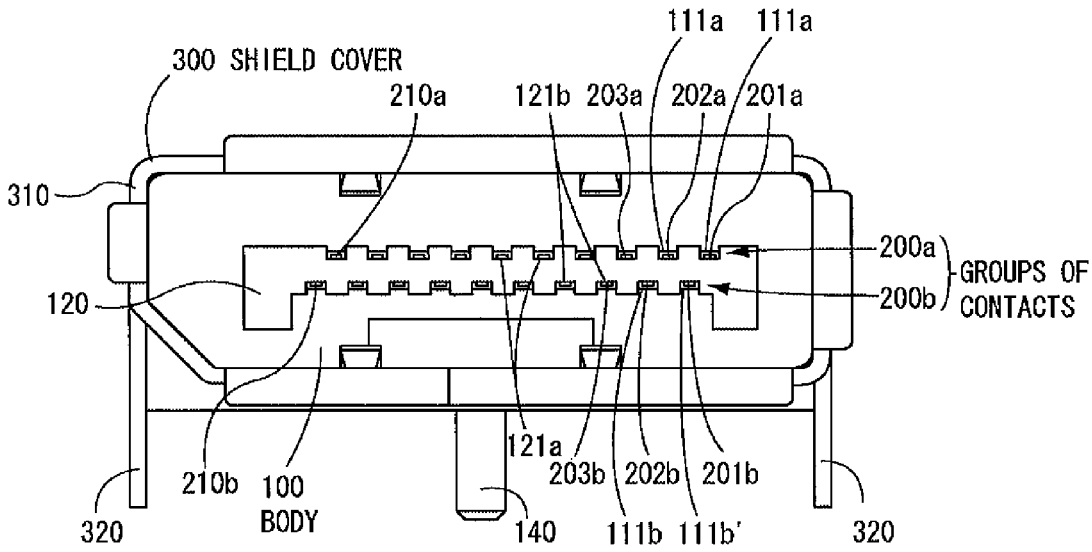
FIG. 1 is a schematic front view of an electric connector according to an embodiment of the present invention.
Figure 2:
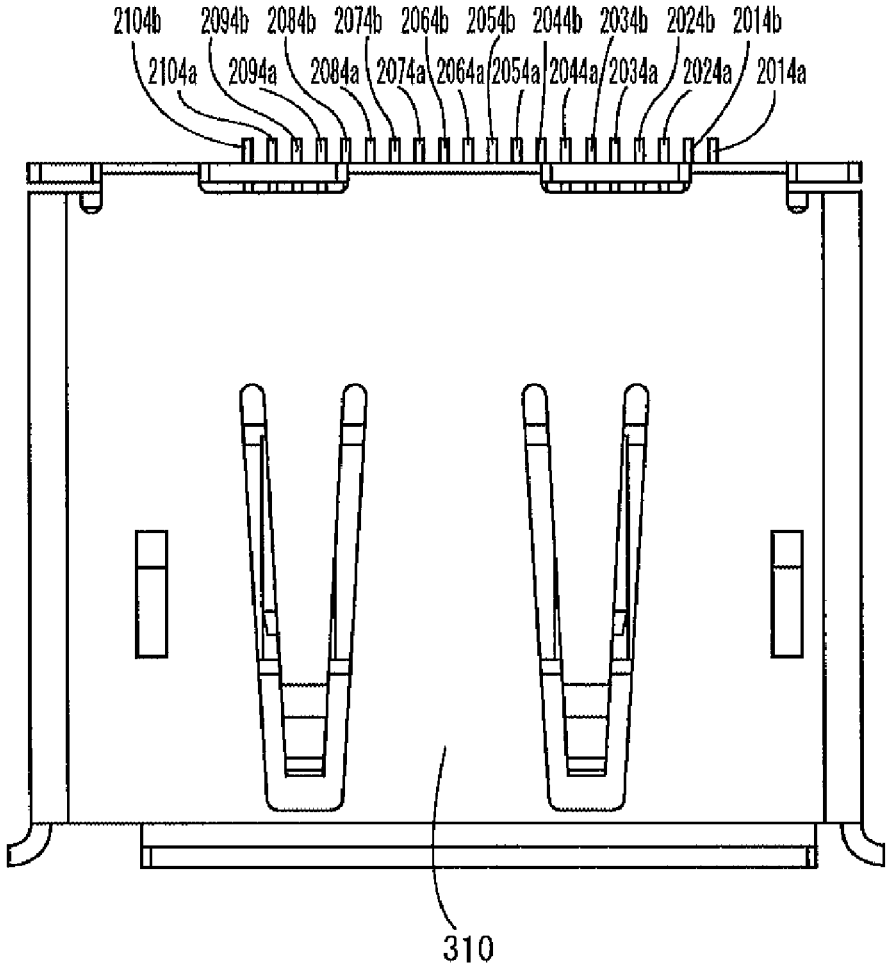
FIG. 2 is a schematic plan view of the electric connector.
Figure 3:
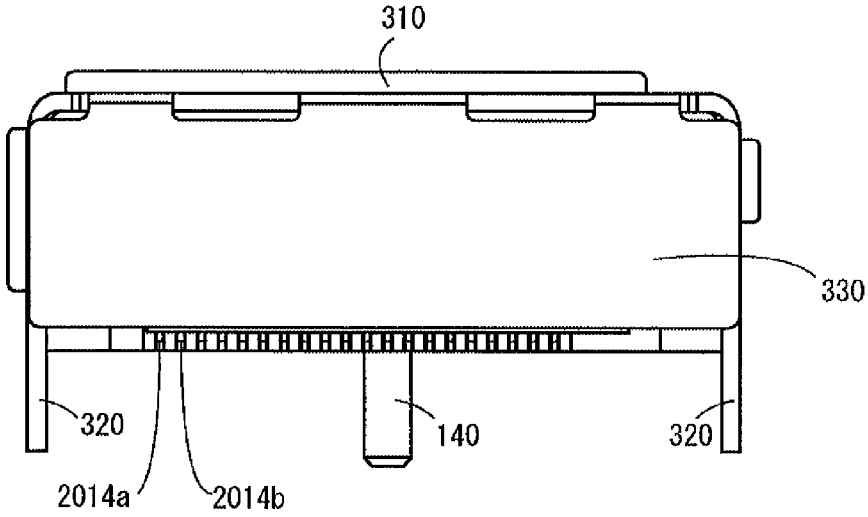
FIGS. 3A and 3B are schematic back views of the electric connector, where
Figure 3:
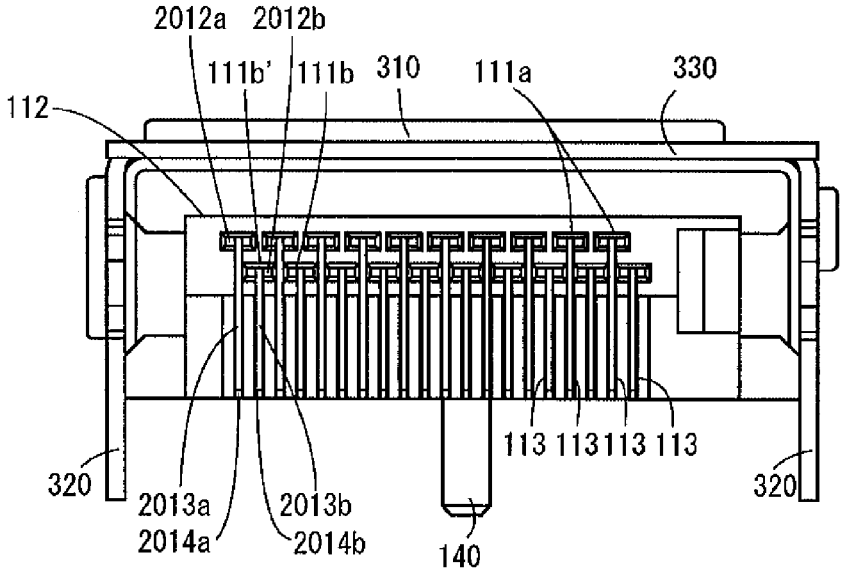
Figure 4:
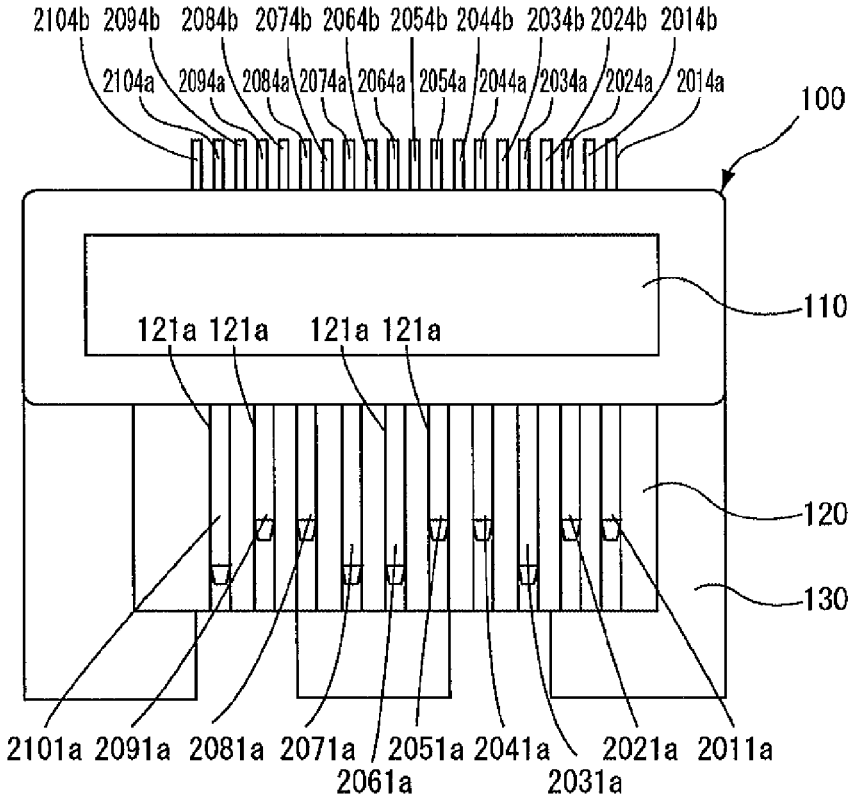
FIG. 4 is a schematic plan view of a body of the electric connector, with groups of contacts attached thereto.

The electric connector shown in FIGS. 1 to 3 is a receptacle to be mounted to a circuit board, capable of high-speed differential signaling. The electric connector includes an insulative body 100, upper and lower groups of contacts 200*a* and 200*b*, and a shield cover 300 covering the outer periphery of the body 100. The upper and lower groups of contacts 200*a* and 200*b* are disposed in spaced relationship inside the body and arranged in two rows in a lateral direction of the body 100 in a staggered or zigzag manner. Each of the components of the electric connector is detailed in the following description.

As shown in FIGS. 1, 3A, 3B, 4 and 5, the body 100 is formed from a synthetic resin for general use such as PBT (polybutylene terephthalate) or PPS (polyphenylene sulfide) by injection molding. The body 100 can be mated with a plug A.

The body 100 includes a main portion 110 having a substantially rectangular solid shape, a projecting portion 120 having a substantially inverted-U shape as viewed from the front, a base 130 having a substantially plate-like shape, and a cylindrical boss 140. The projecting portion 120 is provided at the front side of the main portion 110 and adapted to enter into a recess provided at a tip end of the plug A. The base 130 is provided under the main portion 110 and extended forward. The boss 140 is formed downward on a bottom surface of the base 130 and fits into a hole (not shown) in the circuit board.

In a central portion of the main portion 110 of the body 100, terminal insertion holes 111*a* and 111*b* are lined at equal pitch intervals in the lateral direction of the electric connector in two rows. These holes in two rows are shifted in phase from one another with spacing in between, so as to correspond to contacts (not shown) of the plug A. As shown in FIG. 1, the widthwise ends of the first terminal insertion holes 111*a* are located in such plan positions as to overlap the widthwise ends of the second terminal insertion holes 111*b*.

The terminal insertion holes 111*a* and 111*b* are through holes of horizontally elongated rectangular shape. Ten such holes are provided in each of the upper and lower rows to correspond to main portions 2012*a* and 2022*b* of the upper and lower groups of contacts 200*a* and 200*b*. Of the twenty terminal insertion holes, all holes other than a terminal insertion hole 111*b*' at the rightmost end in the lower row in FIG. 1 are identical to one another. The terminal insertion hole 111*b*' at the rightmost end is a through hole of a horizontally elongated rectangular shape, is wider than the other terminal insertion holes 111*a* and 111*b*, and corresponds to a main portion 2012*b* in the lower group of contacts 200*b*. Regarding the terminal insertion hole 111*b*' at the rightmost end, an apostrophe is added to the reference numeral as above for distinction from the other terminal insertion holes 111*b*.

Figure 5:
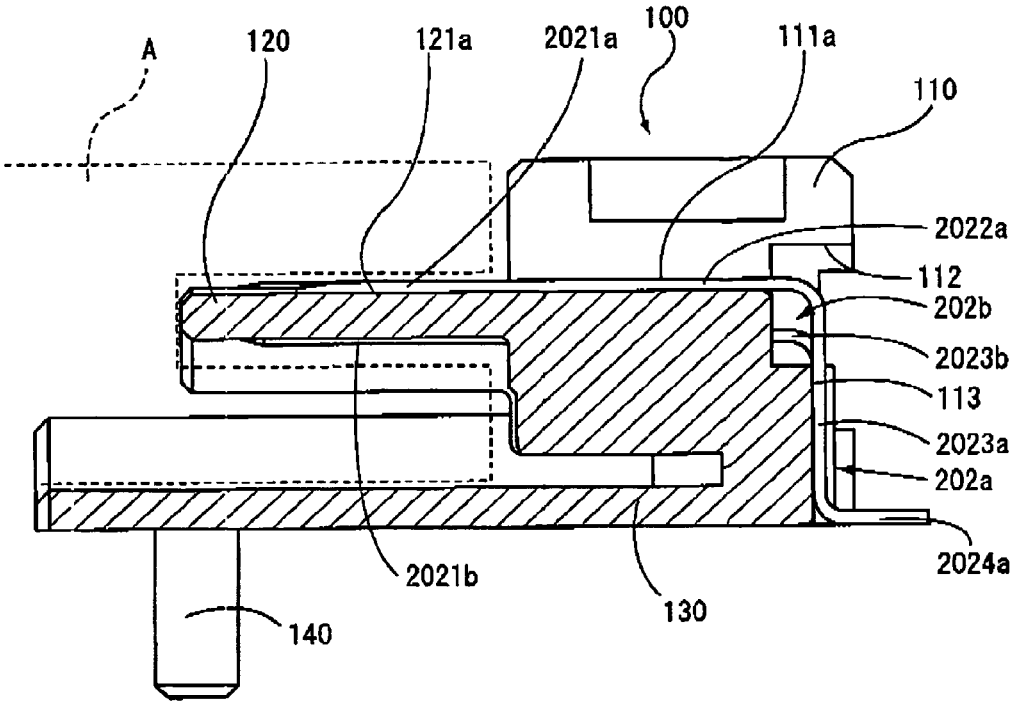
FIG. 5 is a schematic cross-sectional view of the body of the electric connector, with the groups of contacts attached thereto.

As shown in FIGS. 3B and 5, a cutout 112 is provided in the rear surface of the main portion 110. In the inner back surface of the cutout 112, there are linear terminal insertion grooves 113 extending downward under the respective terminal insertion holes 111*a* and 111*b*. The terminal insertion grooves 113 are long grooves arranged in the lateral direction of the body. The terminal insertion grooves 113 correspond in lateral width to lead-out portions 2013*a* and 2013*b* of the upper and lower groups of contacts 200*a* and 200*b*.

As shown in FIG. 1, in an upper surface of the projecting portion 120 of the body 100, there are provided with terminal guide grooves 121*a* communicating with the terminal insertion holes 111*a* in the main portion 110 and extending in straight lines in a longitudinal direction of the body 100. In the lower surface of the projecting portion 120, there are provided with terminal guide grooves 121*b* communicating with the terminal insertion holes 111*b* in the main portion 110 and extending in straight lines in a longitudinal direction of the body 100. The terminal guide grooves 121*a* and 121*b* correspond in lateral width to contact portions 2011*a* and 2011*b* of the upper and lower groups of contacts 200*a* and 200*b*. The terminal guide grooves 121*a* and 121*b* are shifted from each other in phase in the lateral direction, in a similar manner to the terminal insertion holes 111*a* and 111*b*.

The shield cover 300, as shown in FIGS. 1 to 3B, is a metal shell which can be brought into contact with an outer peripheral shield (not shown) of the plug A as mated with the body 100. The shield cover 300 includes a cover main body 310, a pair of legs 320 extending downward from opposite widthwise ends of the cover body 310, and a back cover 330 for openably covering an opening on the back side of the cover body 310.

The cover body 310, shaped as a substantially square cylinder, fits about the main portion 110 of the body 100 so as to cover four sides—upper, lower, right and left sides—of the main portion 110 and the projecting portion 120 (i.e., the outer peripheries of the main portion 110 and the projecting portion 120).

The legs 320 are inserted into attachment holes (not shown) in the circuit board and are connected to a ground pattern on the circuit board.

The back cover 330 is a plate-like member that has its upper end pivotably attached to an upper edge of the opening on the rear side of the cover main body 310. The back cover 330 closes the opening on the rear side of the cover main body 310 so as to cover the rear side of the main portion 110 of the body 100.

Figure 6:
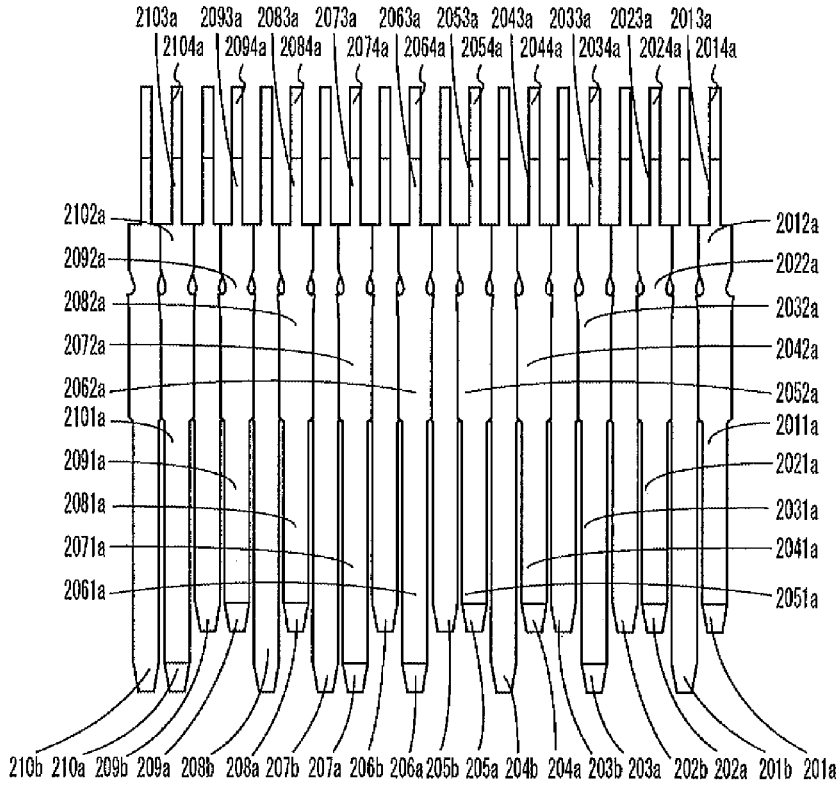
FIGS. 6A and 6B show arrangement of contacts of the electric connector, where
Figure 6:
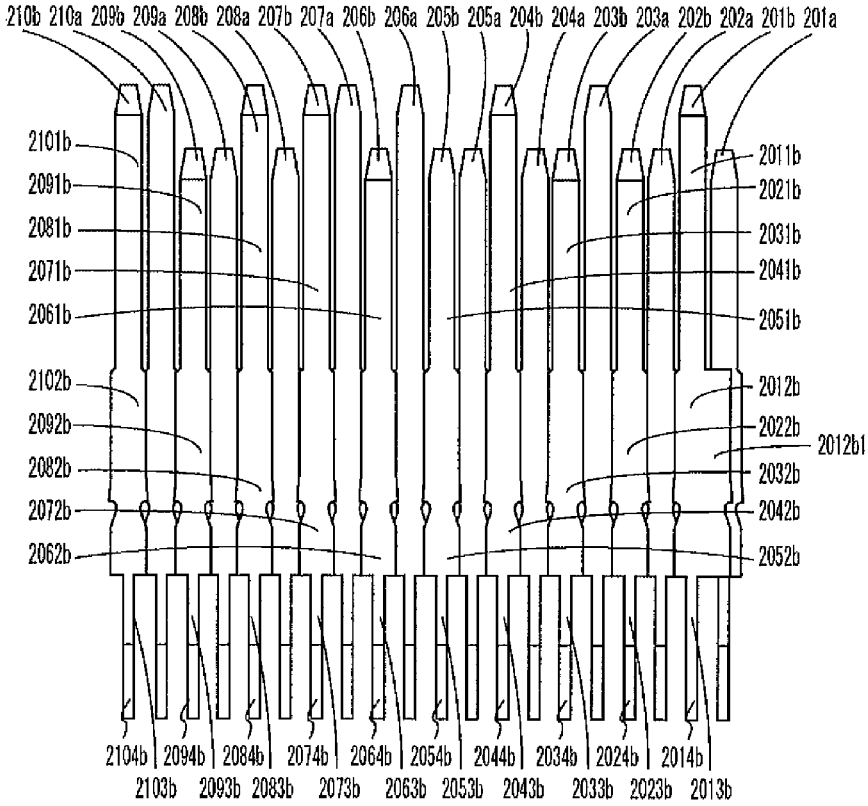
Figure 7:
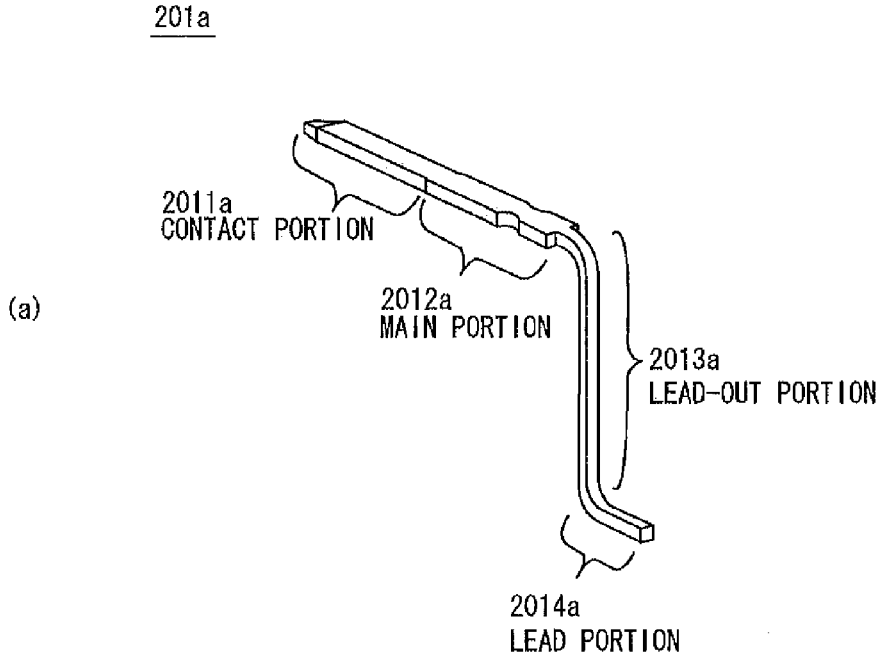
FIG. 7A is a schematic perspective view of a first or a second contact of the electric connector.
FIG. 7B is a schematic perspective view of a second contact at an outermost end of the electric connector.
Figure 7:
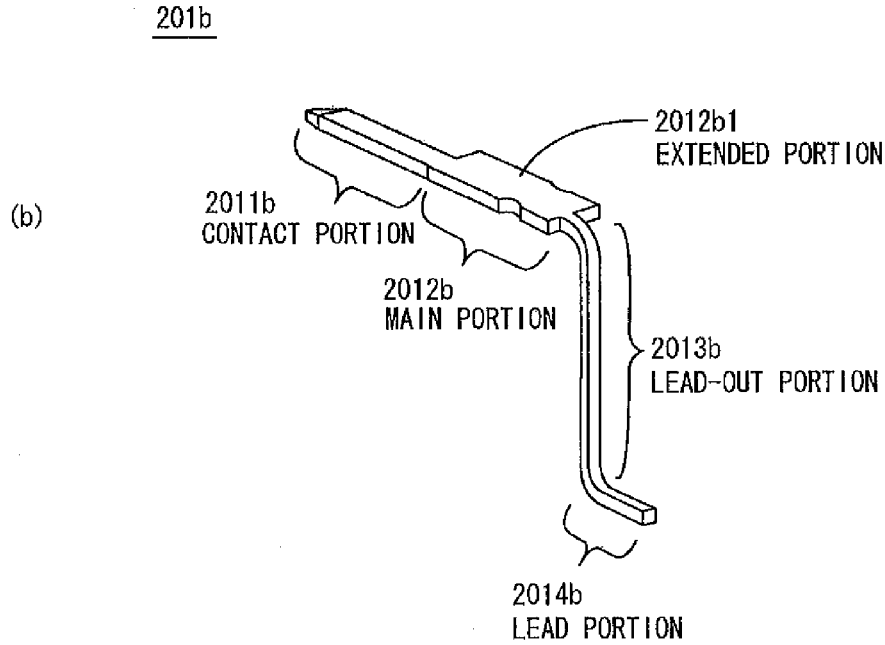

As shown in FIGS. 6A and 6B, the upper contact group 200*a* consists of contacts 201*a*-210*a*. The lower contact group 200*b* consists of contacts 201*b*-210*b*.

As shown in FIGS. 6A to 7B, the contact 201*a* includes a contact portion 2011*a*, a main portion 2012*a*, a lead-out portion 2013*a*, and a lead portion 2014*a*. The contact portion 2011*a* is a plate-like portion that can be brought into contact with a contact (not shown) of the plug A as engaged with the projecting portion 120 of the body 100. The main portion 2012*a*, a plate-like portion with a larger width than that of the contact portion 2011*a*, is provided continuously from the rear end of the contact portion 2011*a* and is adapted to be press fitted into the associated terminal insertion hole 111*a* in the body 100. The lead-out portion 2013*a*, a rod-like portion provided continuously from the rear end of the main portion 2012*a*, is bent at a substantially right angle so as to extend along the rear surface of the body 100. The lead portion 2014*a*, a rod-like portion provided continuously from the rear end of the lead-out portion 2013*a*, is bent at a substantially right angle so as to be connected to a pattern on the circuit board.

The contact 202*b* includes a contact portion 2021*b*, a main portion 2022*b*, a lead-out portion 2023*b*, and a lead portion 2024*b*. The contact portion 2021*b* is a plate-like portion which can be brought into contact with a contact (not shown) of the plug A as engaged with the projecting portion 120 of the body 100. The main portion 2022*b*, a plate-like portion with a larger width than that of the contact portion 2021*b*, is provided continuously from the rear end of the contact portion 2021*b* and is adapted to be press fitted into the associated terminal insertion hole 111*b* in the body 100. The lead-out portion 2023*b*, a rod-like portion provided continuously from the rear end of the main portion 2022*b*, is bent at a substantially right angle so as to extend along the rear surface of the body 100. The lead portion 2024*b*, a rod-like portion provided continuously from the rear end of the lead-out portion 2023*b*, is bent at a substantially right angle so as to be connected to the pattern on the circuit board.

As shown in FIG. 3B, the contacts 201*a* and 202*b* are different from each other in that the lead-out portion 2013*a* is longer than the lead-out portion 2023*b* by the length of distance between the upper row and the lower row. Contacts 202*a*, 204*a*, 205*a*, 208*a* and 209*a* are the same as the contact 201*a*. Contacts 203*a*, 206*a*, 207*a* and 210*a* are the same as the contact 201*a* except that their contact portions 2031*a*, 2061*a*, 2071*a* and 2101*a* are each longer than the contact portion 2011*a* of the contact 201*a*.

Contacts 203*b*, 205*b*, 206*b* and 209*b* are the same as the contact 202*b*. Contacts 204*b*, 207*b*, 208*b* and 210*b* are the same as the contact 202*b* except that their contact portions 2041*b*, 2071*b*, 2081*b* and 2101*b* are each longer than the contact portion 2021*b* of the contact 202*b*.

As shown in FIG. 6B, a contact 201*b* is the same as the contact 202*b*, except that its contact portion 2011*b* is longer than the contact portion 2021*b* of the contact 202*b* and that it has a plate-like extended portion 2012*b*1 along a widthwise end of the main portion 2012*b*.

The electric connector according to the present embodiment is used as a power source line and also used for transmission of single end signals and first to fifth differential signals. The contacts 207*a*, 210*a*, 207*b*, 209*b* and 210*b* are connected to a pattern on the circuit board to function as contacts used in a power supply line or for single-ended signaling. On the other hand, as connected to the pattern on the circuit board, the contacts 201*a*, 202*b*, 204*a*, 205*b* and 208*a* function as positive signal contacts (i.e., one of first contacts in each pair) for transmission of the first to fifth differential signals, the contacts 202*a*, 203*b*, 205*a*, 206*b* and 209*a* function as negative signal contacts (i.e., the other one of the first contacts in each pair) for transmission of the first to fifth differential signals, and the contacts 201*b*, 203*a*, 204*b*, 206*a*, and 208*b* function as common ground contacts (i.e., second contacts) for transmission of the first to fifth differential signals, respectively.

Among the upper and lower groups of contacts 200*a* and 200*b*, of special note are the contacts 201*a*-206*a*, 208*a*, 209*a*, 201*b*-206*b* and 208*b* for transmission of the first to fifth differential signals. As shown in FIG. 1, these contacts are disposed in five sets of triangular arrangements on a cross sectional plain of the body 100: each triangular set is formed by one positive signal contact and one negative signal contact disposed at the bottom side of the triangular arrangement and one common ground contact disposed at the apex. These five sets are sequentially arranged in the lateral direction of the body 100 with their vertical orientations alternately inverted.

In the electric connector in the present embodiment, the contacts for signal transmission and other use are arranged in the above-described relationship. Therefore, for the purpose of reducing a skew, etc. between adjacent contacts of each differential pair and between the differential pairs, the longitudinal relationship among the contact portions 2011*a*-2111*a* of the contacts 201*a*-120*a* and the contact portions 2011*b*-2111*b* of the contacts 201*b*-210*b* is established as shown in FIGS. 6A and 6B.

The contacts 201*a*-210*a* are positioned and inserted into ten associated terminal insertion holes 111*a* in the body 100 from the rear side of the body 100. Then, the contact portions 2011*a*-2101*a* of the contacts 201*a*-210*a* are received in the respective ten terminal guide grooves 121*a* in the body 100. Simultaneously therewith, the main portions 2012*a*-2102*a* of the contacts 201*a*-210*a* are press fitted within the respective ten terminal insertion holes 111*a*, and the lead-out portions 2013*a*-2103*a* are received in respective ten of the terminal insertion grooves 113.

Meanwhile, the contacts 201*b*-210*b* are positioned and inserted into the terminal insertion hole 111*b*' and the nine terminal insertion holes 111*b* in the body 100, respectively, from the rear side of the body 100. Then, the contact portions 2011*b*-2101*b* of the contacts 201*b*-210*b* are received in the respective ten terminal guide grooves 121*b* in the body 100. Simultaneously therewith, the main portions 2012*b*-2102*b* of the contacts 201*b*-210*b* are press fitted within the terminal insertion hole 111*b*' and the nine terminal insertion holes 111*b*, respectively, and the lead-out portions 2013*b* to 2103*b* are received in the remaining ten terminal insertion grooves 113.

As shown in FIGS. 6A and 6B, in the upper contact group 200*a* and the lower contact group 200*b* as fixed to the body 100 in the above-described manner, the widthwise ends of the main portions 2012*a*-2102*a* of the contacts 201*a*-210*a* are located in such plain positions as to overlap the widthwise ends of the main portions 2012*b*-2102*b* of the contacts 201*b*-210*b*.

As a consequence, in any one of the common ground contacts, opposite widthwise ends of the main portion are located in such plain positions as to overlap an inner widthwise end of the main portion of the adjacent plus signal contact and an inner widthwise end of the main portion of the minus signal contact. In addition, adjacent to these plus signal contact and minus signal contact, the common ground contacts in other sets are arranged. This arrangement of the contacts achieves excellently matched impedances in the respective differential pairs of contacts.

The overlapping width and area (N1) of the extended portion 2012*b*1 of the main portion 2012*b* of the contact 201*b* overlapping the main portion 2012*a* of the contact 201*a* is approximately twice as large as each overlapping width and area (N2) of the ends of main portions of any other two contacts for differential signaling (i.e., the outer end and the inner end in each triangular set-for example, an end of the main portion 2032*a* of the contact 203*a* and an end of the main portion 2022*b* of the contact 202*b* that are next to each other). In this manner, adjustment is made to the width and area of the main portion 2012*b* of the contact 201*b*, in accordance with the difference in impedance from other signal contacts with respect to common ground contacts. This structure prevents reduction in capacitance between the contact 201*a* and the contact 201*b* that should have been created due to the location of the contact 201*a* at the outmost end of the upper group of contacts 200*a* and absence of a neighboring common ground contact. Consequently, it becomes possible to suppress variation in impedance within the differential pair located at the outmost end of the groups of contacts, providing matched impedances.

With the electric connector as described above, impedance can be matched within the differential pair at an outmost end of the groups of contacts without adding a dummy ground contact or changing the shape of the shield cover 300 as has been previously described. Matched impedances within each pair should result in matched impedances among the differential pairs. Accordingly, the transmission characteristics of the electric connector can be improved without increase in costs.

It should be noted that any change in design can be made to the above-described electric connector as long as it includes an insulative body and groups of contacts disposed in spaced relationship inside the body, the contacts being arranged in at least two rows in a lateral direction of the body, as long as the groups of contacts include a plurality of first contacts; and a plurality of second contacts located in a different row from a row where their associated first contacts exist, the second contacts being arranged next to the first contacts, and as long as, out of one of the first contacts and one of the second contacts subject to impedance tuning, one of these two contacts has a width and an area thereof adjusted in accordance with a difference in impedance from impedances between other first and second contacts.

Although it is described in the above-described embodiment that adjustment is made to the width and area of the common ground contact located at an outermost end in the groups of contacts, the present invention is not limited thereto. For instance, the width and area of the main portion 2012*a* of the contact 201*a*, which is a signal contact, may be reduced as compared with other signal contacts, thereby preventing reduction in capacitance between the contacts 201*a* and 201*b* to match the impedances.

Further, although it is described in the above-described embodiment that the contacts subject to impedance tuning are the contacts 201*a*, 202*a*, and 201*b* that are the differential pair and the common ground contact thereof at the outermost end in the groups of contacts, the present invention is not limited thereto. That is, contacts subject to impedance tuning may be appropriately selected depending on the arrangement of the contacts.

The present electric connector can be applied to an electric connector for unbalanced (single-ended) signaling. More particularly, adjustment may be made to a single-ended signal contact and a ground contact thereof subject to impedance tuning, by adjusting a width and area of one of these two contacts in accordance with the difference in impedance from another set of a single-ended signal contact and a ground contact.

The geometry of the contacts is not limited to one described in the above-described embodiment, and any change in design can be made.

The arrangement design of the contacts can be changed as appropriate, so long as the contacts are arranged with spacing in at least two rows in the lateral direction inside the body. In the case where the present electric connector is an electric connector for differential signaling, it is preferable that, with a positive signal contact, a negative signal contact, and a common ground contact constituting a set in a triangular arrangement as described above, a plurality of such sets are arranged one set after another in the lateral direction, the present invention is not limited thereto. The contact arrangement may be modified to such that, for example, a plurality of positive and negative signal contacts are arranged in a first row, and a plurality of common ground contacts are arranged in a second row. The contacts can also be arranged such that their widthwise ends do not overlap one another in their plain positions, In addition, although the above electric connector is described as a receptacle, it may also be a plug having contacts connected to a cable.

What is claimed is:

1. An electric connector comprising:

an insulative body; and groups of contacts disposed in spaced relationship inside the body, the contacts being arranged in at least two rows in a lateral direction of the body, wherein the groups of contacts include:

a plurality of first contacts; and a plurality of second contacts located in a different row from a row where their associated first contacts exist, the second contacts being arranged next to the first contacts, and out of one of the first contacts and one of the second contacts subject to impedance tuning, one of said one of the first contacts and said one of the second contacts has a width and an area thereof adjusted to reduce a difference in impedance between an impedance of the first contacts and said one of the second contacts, and an impedance of any other first contact and its adjacent second contact.

2. The electric connector according to claim 1, wherein the first and second contacts subject to impedance tuning are first and second contacts at an outermost end in the groups of contacts arranged in the lateral direction of the body.

3. The electric connector according to claim 1, wherein the groups of contacts are arranged such that a plurality of sets are disposed in the lateral direction of the body with respective vertical positional relationships of the sets turned upside down alternately, each of the sets being made up by a pair of first contacts and a second contact, the first contacts being signal contacts and the second contact being a ground contact.

4. The electric connector according to claim 3, wherein in each of the sets, the pair of first contacts each have first and second widthwise ends, and the second contact has first and second widthwise ends, and the first end of the second contact is so positioned as to overlap the second end of one of the paired first contacts, and the second end of the second contact is so positioned as to overlap the first end of the other of the paired first contacts.

5. The electric connector according to claim 2, wherein the groups of contacts are arranged such that a plurality of sets are disposed in the lateral direction of the body with respective vertical positional relationships of the sets turned upside down alternately, each of the sets being made up by a pair of first contacts and a second contact, the first contacts being signal contacts and the second contact being a ground contact.

6. The electric connector according to claim 5, wherein in each of the sets, the pair of first contacts each have first and second widthwise ends, and the second contact has first and second widthwise ends, and the first end of the second contact is so positioned as to overlap the second end of one of the paired first contacts, and the second end of the second contact is so positioned as to overlap the first end of the other of the paired first contacts.

7. The electric connector according to claim 6, wherein an overlapping width and area N1 is larger than an overlapping width and area N2, wherein N1 is an overlapping width and area where the first end of the second contact at the outermost widthwise end of the groups of contacts overlaps, in plain position, a first contact at the outermost end, and N2 is an overlapping width and area where the second end of another second contact overlaps, in plain position, the first end of another first contact.

8. The electric connector according to claim 6, wherein the first contacts each include:

a first main portion to be held in the body;

a first contact portion continuous from a distal end of the first main portion and exposed from a first end in a longitudinal direction of the body;

a first lead-out portion continuous from a rear end of the first main portion and exposed from a second end in the longitudinal direction of the body; and a first lead portion continues from a rear end of the first lead-out portion, the second contacts each include:

a second main portion to be held in the body, an widthwise end of the second main portion being located in such a plain position as to overlap an widthwise end of the first main portion of the nearest first contact;

a second contact portion continuous from a distal end of the second main portion and exposed from the first end in a longitudinal direction of the body;

a second lead-out portion continuous from a rear end of the second main portion and exposed from the second end in the longitudinal direction of the body;

a second lead portion continuous from a rear end of the second lead-out portion, wherein, in each of the sets of contacts, the first main portions of the pair of first contacts each have first and second widthwise ends, and the second main portion of the second contact has first and second widthwise ends, the first end of the second main portion is so positioned as to overlap the second end of the first main portion of one of the paired first contacts, and the second end of the second main portion is so positioned as to overlap the first end of the main portion of the other of the paired first contacts, and an overlapping width and an area N1 is larger than an overlapping width and area N2, wherein N1 is an overlapping width and area where the first end of a second main portion of a second contact at an outermost widthwise end of the groups of contacts overlaps, in plain position, a first main portion of a first contact at the outermost end, and N2 is an overlapping width and area where the second end of a second main portion of another second contact overlaps, in plain position, the first end of a first main portion of another first contact.

9. The electric connector according to claim 7, wherein the overlapping width and area N1 is substantially twice as large as the overlapping width and area N2.

10. The electric connector according to claim 8, wherein the overlapping width and area N1 is substantially twice as large as the overlapping width and area N2.

* * * * *